US005415685A

United States Patent [19]

Paneccasio, Jr. et al.

[11] Patent Number: 5,415,685

[45] Date of Patent: May 16, 1995

[54] ELECTROPLATING BATH AND PROCESS FOR WHITE PALLADIUM

[75] Inventors: Vincent Paneccasio, Jr., Madison; Elena Too, Bramford, both of Conn.

[73] Assignee: Enthone-Omi Inc., West Haven, Conn.

[21] Appl. No.: 106,672

[22] Filed: Aug. 16, 1993

[51] Int. Cl.[6] ..... C25D 3/52

[52] U.S. Cl. ..... 106/1.21; 205/265

[58] Field of Search ..... 205/257, 265; 106/1.21

[56] References Cited

U.S. PATENT DOCUMENTS

| | | | |
|---|---|---|---|
| 3,458,409 | 7/1969 | Hayashi et al. | 204/43 |
| 3,580,820 | 5/1971 | Yamamura et al. | 204/43 |
| 3,637,474 | 1/1972 | Zuntini et al. | 204/47 |
| 3,677,909 | 7/1972 | Yamamura et al. | 204/43 |
| 3,925,170 | 12/1975 | Skomoroski et al. | 204/43 |
| 4,066,517 | 1/1978 | Stevens et al. | 204/43 |
| 4,076,599 | 2/1978 | Caricchio et al. | 204/47 |
| 4,098,656 | 7/1978 | Deuber | 204/47 |
| 4,100,039 | 7/1978 | Caricchio et al. | 204/43 |
| 4,297,177 | 10/1981 | Fletcher et al. | 204/43 |
| 4,299,670 | 11/1981 | Yahalom | 204/29 |
| 4,339,311 | 7/1982 | Branik | 204/47 |
| 4,406,755 | 9/1983 | Morrissey | 204/47 |
| 4,486,274 | 12/1984 | Abys et al. | 204/44 |
| 4,487,665 | 12/1984 | Miscioscio et al. | 204/47 |
| 4,673,472 | 6/1987 | Morrissey et al. | 205/257 |
| 4,741,818 | 5/1988 | Nobel et al. | 205/257 |

FOREIGN PATENT DOCUMENTS 1014045 12/1965 United Kingdom .

OTHER PUBLICATIONS

Modern Electroplating, 2nd Ed., F. A. Lowenheim (Ed.), 1963 pp. 271–277.

*Primary Examiner*—John Niebling
*Assistant Examiner*—Kishor Mayekar
*Attorney, Agent, or Firm*—DeLio & Peterson

[57] ABSTRACT

The present invention relates to an improved metallic additive free palladium electroplating bath comprising the use of a sulfonic acid compound in combination with a special class of pyridine related nitrogen compounds to both stabilize the bath and to provide white palladium deposits over a wide range of plating thicknesses.

14 Claims, No Drawings

ELECTROPLATING BATH AND PROCESS FOR WHITE PALLADIUM

BACKGROUND OF THE INVENTION

The present invention relates to a metallic additive free electroplating bath for the deposition of white palladium metal on various surfaces and, in particular, to the use of an unsaturated sulfonic compound in combination with a special class of pyridine related nitrogen compounds in the bath to both stabilize the bath and to provide whiter palladium deposits over a wider range of plating thicknesses than conventional processes.

White colored finishes on decorative items such as jewelry are usually of silver, rhodium, palladium or their respective alloys. Each of these plated surfaces has its own specific drawbacks however, since silver surfaces lack durability due to tarnishing, rhodium processes are inefficient and costly to use and conventional palladium deposits do not have the pleasing white appearances of either rhodium or silver.

Several earlier patents on plating palladium address these problems and use small amounts of organic and/or metallic brighteners in the palladium bath to impart the desired color and brightness to the palladium. Deposits obtained from such baths still lack the specularity and whiteness of silver or rhodium however, and as the plated thickness exceeds about 1 micron the palladium gradually loses its brilliance. Moreover, metallic brighteners (i.e., Co or Ni) may cause an allergenic reaction with the skin and the use of these additives is objectionable to the jewelry industry.

Electroplating baths designed to improve the brightness of palladium or palladium alloy deposits on metal substrates are known in the art. See, for example, U.S. Pat. No. 4,098,656 which issued to Deuber in 1978. In this patent the improved brightness is achieved by utilizing in the bath both a Class I and a Class II organic nickel brightener and an adjusted pH range from 4.5 to 12. U.S. Pat. No. 4,406,755 to Morrissey relates to bright palladium electroplating solutions and utilizes aqueous solutions containing palladium complexed with an organic polyamine, and also containing both a cyclic organic imide and a nitrogen-containing heterocyclic organic compound at least one nitrogen of which is incorporated into a six-membered ring.

U.S. Pat. No. 4,487,665 to Miscioscio et al. discloses that thin, white palladium metal deposits can be readily obtained from very specific electroplating bath formulations containing a bath soluble source of palladium and a bath soluble ammonium conductivity salt, chloride ions, and a brightener from the groups of organic and inorganic brighteners, preferably the combined use of both an organic and an inorganic brightener such as 2-Formylbenzene sulfonate, sodium salt and nickel sulfate.

The need still exists for electroplating baths which provide a white palladium metal deposit without the need for metallic brighteners such as nickel and cobalt and it is an object of the present invention to provide a stable palladium electroplating solution wherein the deposits are bright in appearance at thicknesses above 1 micron and preferably up to about 5 microns.

Further objects and advantages will be apparent from the following description.

SUMMARY OF THE INVENTION

It has been found that white palladium metal and palladium metal alloy electroplated deposits may be made by using in conventional palladium electroplating baths an unsaturated sulfonic compound having the general formula A-$SO_2$-B (as defined hereinbelow) in combination with a pyridine related compound such as a substituted pyridine, quinoline or substituted quinoline or phenanthroline or substituted phenanthroline. Broadly stated the nitrogen containing heterocyclic compounds may be represented by the general formulas:

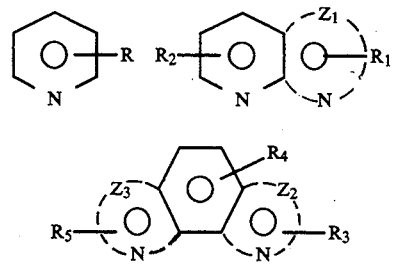

wherein:

$Z_1$, $Z_2$ and $Z_3$ represent a group of atoms necessary to complete a six membered aromatic ring containing at least 1 nitrogen atom; and R, $R_1$, $R_2$, $R_3$, $R_4$ and $R_5$ are hydrogen or are independently selected from one or more of the group consisting of hydroxyl; halogen; nitro; amino; pyridyl; quinoyl; and $C_1$–$C_8$ unsubstituted and substituted aryl, aryloxy, alkyl, alkoxy or alkenyl groups, with the proviso that R cannot be hydrogen and must be a group selected from one of the above groups.

Preferred embodiments are compounds where a nitrogen atom of the compound is quaternized by reaction with an alkylating agent or an oxidizing agent like hydrogen peroxide to form an N-oxide, for example, the alkali metal salt of 2-bromoethane sulfonic acid, sodium salt; propane sultone; butane sultone; dimethyl sulfate; methyl p-toluene sulfonate or similar compound to form the corresponding sulfobetain derivative.

DETAILED DESCRIPTION OF THE INVENTION

Any suitable substrate may be plated using the method and baths of the invention and usually the substrates are bright nickel, brass, copper and bronze.

The palladium is supplied to the electroplating bath of the present invention in any electrodepositable form. Stability of the bath is improved if a palladous complex is employed, such as the urea or an amine complex. Suitable examples are the palladous amine complexes with chloride, bromide, nitrite and sulfite. Palladium diaminodinitrite is preferred. The palladium metal content of the plating bath normally is in the range of 0.1 to 50 g/l. For obtaining a strike plate a concentration of 1 to 10 g/l is preferred, and for ordinary plating a concentration of from 3 to 12 g/l and preferably about 6 g/l is preferred.

The sulfonic compound is generally unsaturated wherein the unsaturation is in the $\alpha$- or $\beta$- position with respect to the sulfonic group. Such compounds have the formula:

$A—SO_2—B$ wherein A is an aryl or alkylene group, substituted or unsubstituted, and B may be —OH, —OR, —OM, —$NH_2$, —NHR —H, —R with M being an alkali metal, ammonium or amine, and R being an alkyl group of not more than 6 carbon atoms. Preferred compounds are when A is an aryl group and B is OH or OM and a highly preferred compound is 2-formylbenzene sulfonic acid (sodium salt).

The preferred nitrogen compounds are selected from the group consisting of substituted pyridines and polypyridines, quinolines, substituted quinolines, phenanthrolines and substituted phenanthrolines and quaternized derivatives thereof, particularly with $CH_3$ or sulfopropyl groups. A highly preferred compound because of its demonstrated activity is 1-(3-sulfopropyl)-2-vinyl-pyridinium-betaine. Other compounds include:

Table 1

2, 2':6'2''-Terpyridine;
2, 2'Biquinoline;
4, 7-Dimethyl-1, 10-phenanthroline;
4-Methyl-1,10-phenanthroline;
4,7-Dihydroxy-1,10-phenanthroline;
5-Methyl-1,10-phenanthroline;
4,7-Phenanthroline;
4,7-Diphenyl-1,10-phenanthroline
trans-1-(2-pyridyl)-2-(4-pyridyl)ethylene;
trans-1,2-bis (4-pyridyl)ethylene; and
2, 2'-Dipyridyl.

Concentration of the individual nitrogen compound may range from 0.0001 to 25 g/l, preferably 1 to 200 ppm and most preferably 2 to 100 ppm, e.g., 2 to 10 ppm for thin deposits up to 1 micron and about 20 to 100 ppm for thick deposits from 1 up to 6 microns or higher. The sulfonic compound may be employed in the bath in amounts of about 0.1 to 20 g/l, preferably 0.5 to 2 g/l, e.g., 0.5–1 g/l.

The pH of the electroplating solution should be maintained at a value of from 5 to 12 in order to avoid stability problems. Values of from about 6 to 8 are preferred for strike plating with a value of about 6.5 being specially preferred. For ordinary electroplating, a pH value of from about 6 to 10 is preferred, with value of about 7 to 8 being more highly preferred. The adjustment of the pH value may readily be accomplished by the addition of any acid or base commonly used for such purposes such as ammonium hydroxide or phosphoric acid or sulfuric acid. The use of ammonium hydroxide assists in promoting the stability of the palladium amine complex, while the use of phosphoric or sulfuric acid promotes conductivity of the solution to thereby minimize hydrogen generation at the cathode.

To further reduce the likelihood of hydrogen formation at the cathode, it is generally desirable to include additional quantities of a conductive salt. Any of the commonly used conductive Salts normally employed in palladium electroplating may be used in the present bath, however, the preferred conductive salt at present is ammonium sulfate and/or ammonium phosphate, dibasic. Again, the presence of ammonium ion promotes the stability of the palladium amine complex whereas the sulfate or phosphate anion improves the conductivity of the solution. A preferred composition contains 40–60 g/l ammonium sulfate and 40–60 g/l ammonium phosphate, dibasic.

The present bath may also be modified to include additives such as metallic brighteners, alloying elements and chelating elements. Suitable metallic brightening agents include cadmium, copper, arsenic and zinc and nickel and cobalt for certain type products. Suitable chelating or sequestering agents include carboxylic acid chelating agents such as EDTA, NTA and the citrates, gluconates and phosphonic chelating agents. A preferred chelating additive is ammonium citrate, dibasic, in an amount of about 10–30 g/l.

The temperature of the palladium bath should be maintained between room temperature and approximately 71° C. The preferred temperature will normally be 38°–54° C. in order to avoid the emission of ammonia from the solution. Current densities of from ASF 0.1 to 50 amps/$ft^2$ (ASF) are suitable. For rack plating, a current density of from 5 to 30 ASF, and preferably about 10 ASF may be employed. For barrel plating, the preferred range is 2 to 7 ASF.

The deposits produced are low stress deposits however, if desired, one of the conventional stress reducing agents such as sulfamic acid, its salts or derivatives may optionally be employed. Concentrations up to 100 g/l are suitable, with concentrations of from 25 to 75 g/l being preferred.

The following examples will serve to more fully illustrate the advantages of this invention.

EXAMPLE I

The following solution was prepared:

| Ingredient | Amount g/l |
|---|---|
| Ammonium sulfate | 50 |
| Ammonium phosphate, dibasic | 50 |
| Ammonium citrate, dibasic | 10 |
| Palladium diaminodinitrite | 6* |
| O-Formyl benzene sulfonic acid, sodium salt | 1 |
| pH | 7–7.5 |

*As palladium metal.

The compounds of Table 1, supra, were added to the above solution in amounts of 2–10 ppm and test panels of polished brass were plated at 20 ASF for 2 minutes at 50° C. (122° F.). A deposit of palladium was obtained which was mirror-bright, haze-free and microcrack-free.

EXAMPLE II

EXAMPLE I was repeated using 1-(3-sulfopropyl)-2-vinylpyridinium betaine (SPV) as the brightener additive in an amount of 2–10 ppm. Excellent plating results were obtained.

COMPARATIVE EXAMPLE

EXAMPLE I was repeated using the following compounds as brightener additives:

(a) 1-(3-sulfopropyl)pyridinium betaine
(b) 1-(2-hydroxy-3-sulfopropyl)-pyridium betaine
(c) Bathophenanthroline, sulfonated, sodium salt.

Hazy deposits were obtained.

With regard to the difference in plating effects between Bathophenantroline, sulfonated, sodium salt, vis-a-vis the same compound without the sulfonation (Table I-4, 7-Diphenyl-1, 10-phenantroline), it is hypothesized that the sulfonation possibly leads to further electron withdrawing within the compound and results in less activity. Other electron withdrawing groups such as nitro would presumably behave similarly.

EXAMPLE III

EXAMPLE II was repeated under the conditions shown below.

TABLE 2

| SAMPLE NO. | SPV (ppm) | Amps/ft$^2$ ASF | Thickness (MICRONS) |
|---|---|---|---|
| 1 | 30–40 | 20 | 3.4 |
| 2 | 50–60 | 20 | 5.0 |
| 3 | 50–60 | 30 | 5.5 |
| 4 | 60–70 | 20 | 6.5 |
| 5 | 60–70 | 30 | 5.5 |
| 6 | 60–70 | 5 | 5.3 |

The results show that by increasing the SPV concentration, mirror bright deposits up to and beyond 5 microns may be achieved. Based on bend tests, these heavy deposits were found to be relatively stress free compared to conventional palladium nickel deposits.

It will be apparent that many changes and modifications of the several features described herein may be made without departing from the spirit and scope of the invention. It is therefore apparent that the foregoing description is by way of illustration of the invention rather than limitation of the invention.

We claim:

1. A method for depositing a white palladium metal coating on a substrate comprising:

(a) immersing the substrate in a palladium electroplating bath having a pH of about 5–12 and containing as brightener additives (1) a sulfonic compound of the formula $A—SO_2—B$ in an amount of about 0.1–20 g/l and wherein A is an aryl or alkylene group, substituted or unsubstituted, and B is selected from the group consisting of —OH, —OR, —OM, —$NH_2$, NHR, —R, with M being an alkali metal, ammonium or amine, and R being an alkyl group of not more than 6 carbon atoms; and (2) a compound of the formula

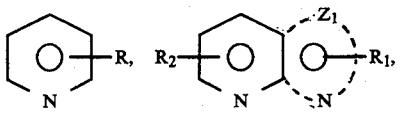

-continued

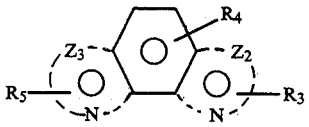

in an amount of about 1 to 200 ppm and wherein $Z_1$, $Z_2$, and $Z_3$ represent a group of atoms necessary to complete a six member aromatic ring containing at least 1 nitrogen atom; and wherein R, $R_1$, $R_2$, $R_3$, $R_4$, RS, are hydrogen or are independently selected from one or more of the group consisting of hydroxyl; halogen; nitro; amino; pyridyl; quinoyl; and $C_1$–$C_8$, substituted or unsubstituted, aryl, aryloxy, alkyl, alkoxy or alkenyl groups, with the proviso that R cannot be hydrogen and must be a group selected from one of the above groups; and (b) plating the substrate using an electric current.

2. The method of claim 1 wherein the sulfonic compound is a compound wherein A is an aryl group and B is OH or OM.

3. The method of claim 1 wherein R is a 2-vinyl group and the nitrogen atom is quaternized with propane sultone.

4. The method of claim 1 wherein $Z_1$ are carbon atoms and $R_1$ and $R_2$ are aryl groups.

5. The method of claim 1 wherein the nitrogen compound is terpyridine.

6. The method of claim 1 wherein $Z_2$ and $Z_3$ are carbon atoms and $R_3$ and $R_4$ are both OH.

7. The method of claim 1 wherein $Z_2$ and $Z_3$ are carbon atoms and $R_4$ is $CH_3$.

8. The method of claim 1 wherein the nitrogen compound is trans-1-(2-pyridyl)-2-(4-pyridyl)ethylene.

9. The method of claim 1 wherein the nitrogen compound is 4,7-Phenanthroline.

10. The method of claim 1 wherein the nitrogen compound is 2, 2'-Dipyridyl.

11. The method of claim 1 wherein the sulfonic compound is O- formyl benzene sulfonic acid, sodium salt and compound (2) is 1-(3-sulfopropyl)-2-vinylpyridinium betaine.

12. The method of claim 1 wherein the amount of the sulfonic component is about 0.5 to 2 g/l.

13. The method of claim 12 wherein the amount of compound 2 is about 2 to 100 ppm.

14. The method of claim 13 wherein the sulfonic compound if O- formyl benzene sulfonic acid, sodium salt and compound (2) is 1-(3-sulfopropyl)-2-vinylpyridinium betaine.

* * * * *

UNITED STATES PATENT AND TRADEMARK OFFICE

CERTIFICATE OF CORRECTION

PATENT NO. : 5,415,685

DATED : May 16, 1995

INVENTOR(S) : Paneccasio, Jr. et al.

It is certified that error appears in the above-identified patent and that said Letters Patent is hereby corrected as shown below:

In column 3, line 59: Please delete "Salts", and insert - -salts- -.

In the Claims

In column 6, line 13: Please delete "RS", and insert - -$R_5$- -.

Signed and Sealed this

Twenty-second Day of August, 1995

Bruce Lehman

*Attest:*

BRUCE LEHMAN

*Attesting Officer*

*Commissioner of Patents and Trademarks*